US007866995B1

(12) United States Patent
Kudo

(10) Patent No.: US 7,866,995 B1
(45) Date of Patent: Jan. 11, 2011

(54) ELECTRICAL CONNECTOR

(75) Inventor: Hironori Kudo, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/801,494

(22) Filed: Jun. 11, 2010

(30) Foreign Application Priority Data

Jun. 19, 2009 (JP) ..... 2009-146497

(51) Int. Cl.
*H01R 13/62* (2006.01)

(52) U.S. Cl. ..... 439/157; 439/327

(58) Field of Classification Search ..... 439/159, 439/160, 157, 152, 327
See application file for complete search history.

(56) References Cited

U.S. PATENT DOCUMENTS 5,577,922 A * 11/1996 Enomoto et al. ..... 439/157
5,660,552 A * 8/1997 Suzuki et al. ..... 439/159

FOREIGN PATENT DOCUMENTS

JP 2000-259779 A 9/2000
JP 2001-052814 A 2/2001
JP 2002-231381 A 8/2002
JP 2004-087201 A 3/2004
JP 2005-108569 A 4/2005
JP 2005-242946 A 9/2005
JP 2005-294231 A 10/2005
JP 2005-302431 A 10/2005

* cited by examiner

*Primary Examiner*—Tho D Ta
*Assistant Examiner*—Travis Chambers
(74) *Attorney, Agent, or Firm*—Rader, Fishman & Grauer PLLC

(57) ABSTRACT

A connector includes a housing, a pair of headers, a pair of crank levers, a pair of ejectors, and a pair of clip arms. When a printed substrate is inserted into the housing, the pair of crank levers is caused to pivot so as to raise the pair of ejectors. Then, by moving the pair of clip arms from a third groove to a second groove at which the width is narrower, a pair of projections fits a pair of locking holes so as to sandwich both sides of the printed substrate. The connector can securely lock the printed substrate since the header prevents widening of the distance of the pair of projections even in a case in which a force aimed to detach the printed substrate from the housing works is acting thereon.

6 Claims, 13 Drawing Sheets

ELECTRICAL CONNECTOR

This application is based on and claims the benefit of priority from Japanese Patent Applications No. 2009-146497, filed on 19 Jun. 2009, the content of which is incorporated herein by reference.

BACKGROUND OF THE INVENTION

1. Field of the Invention

The present invention relates to an electrical connector. Specifically, the present invention relates to a structure of an electrical connector including a locking mechanism that ensures engaging and releasing between the electrical connector and a printed substrate.

2. Related Art

A main printed substrate mounting a CPU is mounted to a main body such as a personal computer or a server. In addition, a compact printed substrate for main memory is connected via the electrical connector on these main printed substrates.

For example, DDR3 (Double-Data-Rate3) SDRAM is a type of DRAM specification that is configured with a semiconductor integrated circuit. DDR3 SDRAM is mounted on a small printed substrate in a specified rectangular shape. This printed substrate includes an edge connector at an edge portion thereof. By the edge connector being inserted into an electrical connector on the main printed substrate, DDR3 SDRAM is electrically connected with the main printed substrate.

Generally, an electrical connector that connects a small printed substrate for memory is vertical installation type and a small printed substrate is installed in a vertical direction with respect to a main printed substrate. Then, an electrical connector is provided with a locking mechanism that engages a small printed substrate so that the small printed substrate thus mounted is not easily detached due to vibration and the like.

The electrical connector such as described above is disclosed in Unexamined Japanese Patent Application Publication No. 2005-294231 (hereinafter referred to as Patent Document 1). Patent Document 1 discloses an invention in which a height of an ejector is made to be low with the aim of minimizing an electrical connector by lowering its height and improving packaging density of the electrical connector while the small printed substrate is configured not to be easily detached from the electrical connector.

The electrical connector according to Patent Document 1 includes a square housing to which an edge portion of a small printed substrate is inserted and extracted from and a pair of headers provided to both wings of this housing. Then, the pair of headers is provided with a pair of grooves facing each other that guides both end edges of the small printed substrate.

A pair of projections facing each other is provided at an inner wall of these grooves and, when a small printed substrate is inserted, a pair of the projections is engaged with through holes that are provided at both wings of the small printed substrate. Thus, it is possible for the electrical connector according to Patent Document 1 to prevent falling out (detachment) of the small printed substrate.

In addition, Patent Document 1 discloses that the electrical connector according thereto includes a pair of ejectors that opens and closes at both wings of the housing, such that, when a pair of the ejectors is opened outwardly, the small printed substrate can be released against a pair of the projections due to the principle of leverage.

However, in a case in which strong vibrations occur to the electrical connector according to Patent Document 1, such that a pair of the projections that is engaged with the through holes provided at both wings of the small printed substrate may cross over the through holes, a pair of walls at which the pair of the projections is provided may open so that the small printed substrate may be detached from the electrical connector.

Thus, an electrical connector is demanded which reliably locks a small printed substrate so that the small printed substrate is not easily detached from the electrical connector.

In addition, since the electrical connector according to Patent Document 1 includes the pair of ejectors that opens outwardly at both wings of the housing, a pair of the ejectors occupies a part of the packaging area of the main printed substrate that mounts this electrical connector. This leads to a problem in that improvement in the packaging density is hindered.

If the ejector mechanism can be configured so as not to occupy the packaging area of the main printed substrate, space can be left for mounting electrical components on the main printed substrate, as a result of which a packaging density of the main printed substrate can be improved, and thus is preferred.

SUMMARY OF THE INVENTION

The present invention is made for addressing such a problem and an object thereof is to provide an electrical connector including a locking mechanism that locks a small printed substrate that is connected and an electrical connector including an ejector mechanism that improves packaging density.

An electrical connector according to a first aspect of the present invention is provided which includes: a housing of a quadrangular shape in which a printed substrate of a rectangular shape including a pair of locking holes at both wings of a connection end portion is inserted and extracted; a pair of headers having base end portions that are disposed at both wings of the housing, and tip portions that extend in parallel; a pair of crank levers that are held to freely swing at the base end portion of the pair of the headers; a pair of ejectors that is held at a pair of the headers to freely advance and retract by a swinging movement of a pair of the crank levers being converted to translatory movement parallel with an inserting and extracting direction of the printed substrate; and a pair of clip arms that projects from the pair of ejectors through the pair of headers, and extends toward each other in a direction perpendicular to an inserting and extracting direction of the printed substrate, in which the pair of headers includes a pair of first grooves facing each other that extends from the tip portions toward the base end portions and guides both end edges of the printed substrate, a pair of second grooves that is in communication with the first grooves and is provided at a width slightly narrower than a width of both side faces of the pair of clip arms, and a pair of third grooves that is in communication with the second grooves and abuts both side faces of the pair of clip arms, in which the pair of crank levers includes a first swing arm that can abut both sides of an end face of the connection end portion and a second swing arm that abuts a bottom face of the pair of ejectors, in which the clip arm includes a gap which opens from the base end portion toward the tip portion and through which the printed substrate can pass, and a pair of projections that is provided at a tip portion of the clip arm and projects to the gap toward each other so as to be capable of fitting the locking hole, and in which, when the printed substrate is inserted into the housing, the pair of crank levers is caused to pivot so that the pair of ejectors is caused to move in a direction opposite to an inserting direction of the printed substrate and the pair of clip arms is caused to move from the pair of third grooves to the pair of second grooves to fit the pair of locking holes so as to sandwich both faces of the printed substrate.

Herein, the housing has insulation properties. The insulative housing may be a housing made of non-conductive material and an insulative housing if a desired shape can be obtained by forming of synthetic resin.

The housing may be in a quadrangular shape, a housing in a quadrangular shape indicating that the electrical connector according to this invention is a quadrangular connector having a coupling face in a rectangular shape. Then, this housing includes a slit-like opening that couples with the printed substrate.

The pair of headers may be separated from the housing and may also be integral with the housing. It is preferable to make a housing with insulative headers by integrating a housing and the pair of headers since it simplifies the configuration of components.

The base end portions of the pair of headers are disposed at both wings of the housing and the tip portions thereof form a shroud of two-wall type that extends substantially in parallel, and the pair of headers has a function of guiding or supporting the printed substrate.

A pivot shaft as a pivot point may be provided at a center for the crank lever, and this pivot shaft is held at the base end portion of the header to freely swing. In the crank lever, when a first swing arm is lowered, a second swing arm can be raised. On the other hand, when the second swing arm is lowered, the first swing arm can be raised.

A crank lever and the ejector may configure a cam device, and in this case, the crank lever is the cam and the ejector is a cam follower. When the printed substrate lowers the first swing arm, it is possible to raise the ejector according to the profile of the second swing arm. Then, the header functions as a frame that allows the ejector only to undergo translatory movement.

Furthermore, the crank lever and the printed substrate may configure a cam device, and in this case, the crank lever is the cam and the printed substrate is the cam follower. When the ejector lowers the second swing arm, it is possible to raise the printed substrate according to the profile of the first swing arm. Then, the header functions as a frame that allows the printed substrate only to undergo translatory movement.

The ejector and the clip arm are integrally configured, and when raising the ejector (when moving in a direction opposite to an inserting direction of the printed substrate), the clip arm moves from the third groove to the second groove, such that the clip arm is elastically deformed toward the gap, a result of which the distance between the pair of projections is shortened. Then, the pair of projections can fit the through hole so as to sandwich both faces of the printed substrate.

According to a second aspect of the present invention, in the electrical connector as described in the first aspect, the pair of ejectors includes a pressing portion at an opposite side to the bottom face of the ejector, and, when the pressing portion is pushed so as to move the pair of ejectors in a direction which is the same as an inserting direction of the printed substrate, the pair of crank levers is caused to pivot so that the pair of first swing arms is caused to eject the printed substrate from the housing and the pair of clip arms is caused to move from the pair of second grooves to the pair of the third grooves so that the pair of projections is spaced apart from the pair of locking holes.

According to a third aspect of the present invention, in the electrical connector as described in the first or second aspect, the projection projects in substantially a columnar manner. Thus, the locking hole fits an outer circumference of the projection so that it makes it difficult for the projection to cross over the locking hole.

According to a fourth aspect of the present invention, in the electrical connector as described in any one of the first to third aspects, the printed substrate includes an edge connector at the connection end portion, and the housing includes a plurality of contacts in a bellows shape that contacts the edge connector.

For example, DDR3 SDRAM can be exemplified as a printed substrate having an edge connector at a connection end portion. A printed substrate may be a single-side printed substrate including an edge connector on a single side thereof, may be a double-side printed substrate including an edge connector on both sides thereof, and may be a multi-layer printed substrate including an edge connector on a single side or both sides thereof.

According to a fifth aspect of the present invention, in the electrical connector as described in the fourth aspect, the housing arranges the contacts to be aligned in two rows.

A connector that arranges the contacts to be aligned in two rows is called a dual inline connector. The dual inline connector can connect multiple signal lines within a limited space. The dual inline connector is suited for connection of a printed substrate for memory having multiple signal lines.

According to a sixth aspect of the present invention, in the electrical connector as described in the fourth or fifth aspect, the contact has a lead portion that is surface mounted. Thus, an electrical connector that enables a surface mounting can be obtained, which contributes to automation of soldering using reflow.

DETAILED DESCRIPTION OF THE INVENTION

The inventors of the present invention have found that these problems could be solved by configuring a locking mechanism including a crank lever that converts translatory movement of a small printed substrate to rotational movement, and an ejector that moves in a direction opposite to a traveling direction of the small printed substrate and by the ejector including a pair of clip arms that securely locks the small printed substrate, and based on this, arrived at inventing the following novel electrical connector.

In the following, a configuration that implements the present invention is explained with reference to the drawings.

Figure 1:
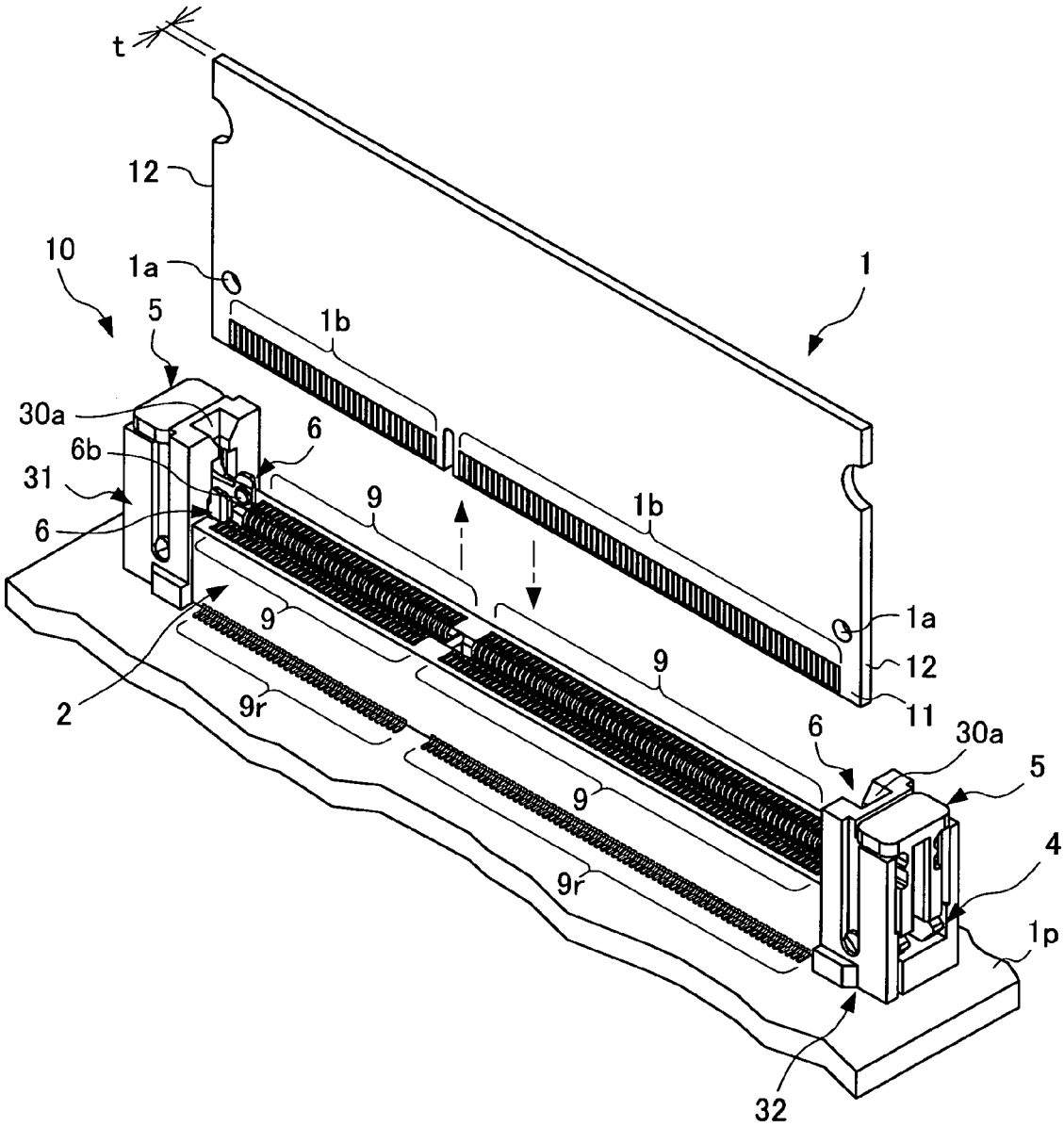
FIG. 1 is a perspective view illustrating a configuration of an electrical connector according to an embodiment of the present invention and shows a state before a small printed substrate is connected.
Figure 2:
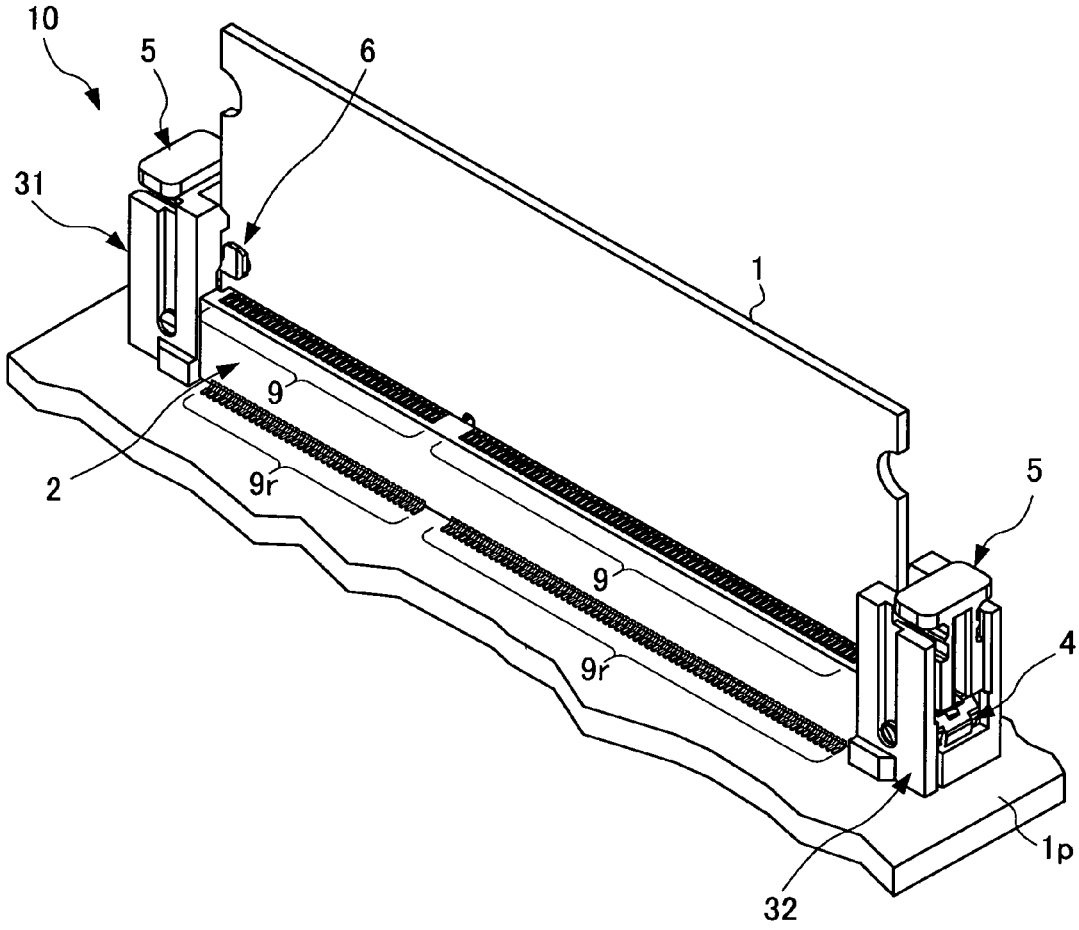
FIG. 2 is a perspective view illustrating a configuration of the electrical connector according to the embodiment and shows a state in which the small printed substrate is connected.

First, a configuration of an electrical connector according to an embodiment of the present invention is explained. FIG. 1 is a perspective view illustrating a configuration of an electrical connector according to an embodiment of the present invention and shows a state before a small printed substrate is connected. FIG. 2 is a perspective view illustrating a configuration of the electrical connector according to the embodiment and shows a state in which the small printed substrate is connected.

Figure 3:
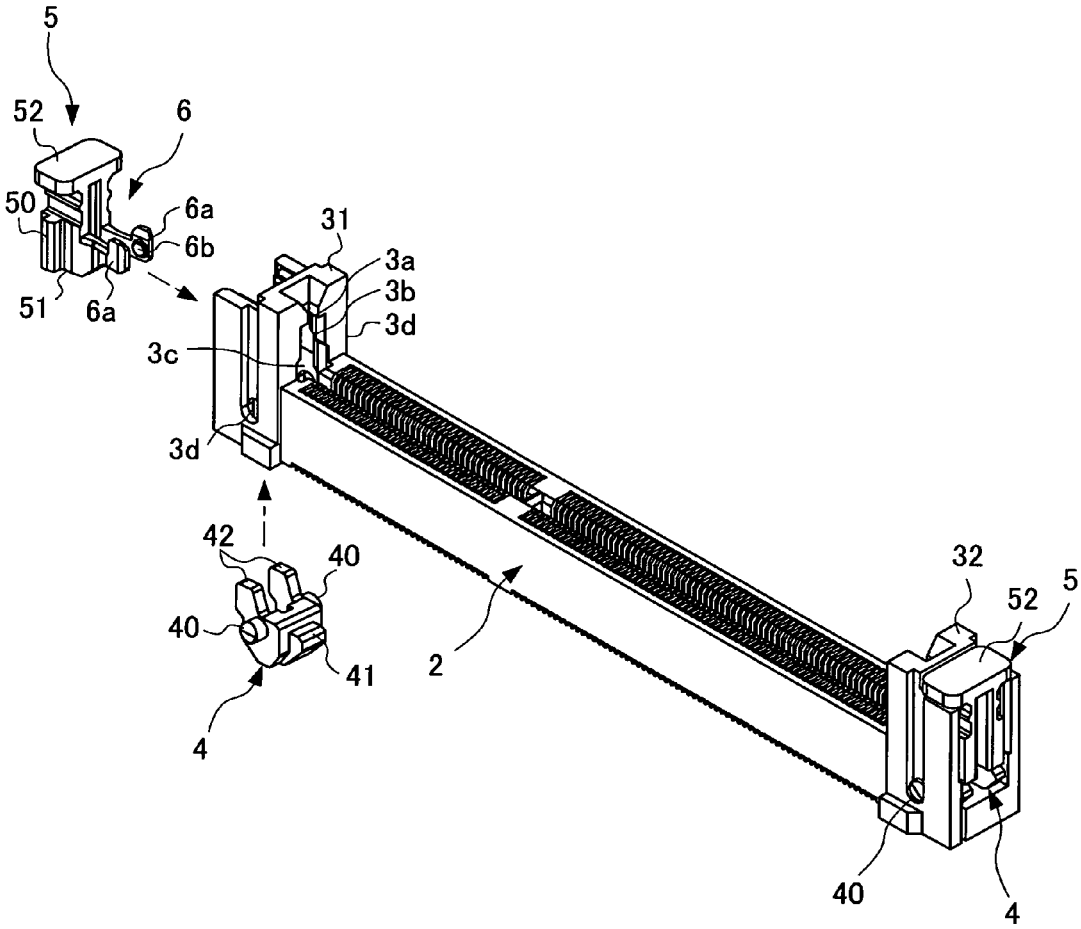
FIG. 3 is an exploded perspective view illustrating a configuration of the electrical connector according to the embodiment and shows a state in which a crank lever and an ejector are incorporated into another header.

Furthermore, FIG. 3 is an exploded perspective view illustrating a configuration of the electrical connector according to the embodiment and shows a state in which a crank lever and an ejector are incorporated into another header.

With reference to FIG. 1 or 2, a printed substrate 1 of a rectangular shape is inserted into or extracted from an electrical connector 10 (hereinafter, referred to as connector) according to an embodiment of the present invention. For example, the printed substrate 1 is memory that functions as DDR3 SDRAM for main memory, a pair of locking holes 1*a* and 1*a* specified by JEDEC (Joint Electron Device Engineering Councils) is opened at both wings of a connection end portion 11. Furthermore, the printed substrate 1 is provided with an edge connector 1*b* specified by JEDEC on both faces of the connection end portion 11.

With reference to FIG. 1 or 2, the connector 10 is configured to be an electrical connector of vertical installation type to which the printed substrate 1 is installed in a vertical direction toward a main printed substrate 1*p*. A housing 2 is provided with a plurality of contacts 9 in a bellows shape that contacts the edge connector 1*b*.

With reference to FIG. 1 or 2, the connector 10 is configured to be a dual inline connector in which the contacts 9 are arranged to be aligned in the housing 2 in two rows. Furthermore, the contacts 9 include lead portions 9*r* that are surface mounted to make a printed substrate connector that surface mounts the connector 10 to the main printed substrate 1*p*.

With reference to FIGS. 1 to 3, the connector 10 includes the housing 2 of a rectangular shape and a pair of headers 31 and 32. The printed substrate 1 is inserted into or extracted from the housing 2. A base end portion of the pair of the headers 31 and 32 is disposed at both wings of the housing 2. Furthermore, tip portions of a pair of the headers 31 and 32 extend substantially in parallel. The housing 2 and a pair of the header 31 and 32 are integrally formed by way of a synthetic resin of insulation.

With reference to FIGS. 1 to 3, the connector 10 includes a pair of crank levers 4 and 4, a pair of the ejectors 5 and 5, and a pair of clip arms 6 and 6. The pair of crank levers 4 and 4 is held at the base end portions of a pair of the headers 31 and 32 to freely swing.

With reference to FIGS. 1 to 3, a pair of the ejectors 5 and 5 is held in a pair of the headers 31 and 32 to freely advance and retract. Regarding the pair of the ejectors 5 and 5, a swinging movement of the pair of the crank levers 4 and 4 is converted to translatory movement thereof that is substantially parallel with an inserting and extracting direction of the printed substrate 1.

With reference to FIGS. 1 to 3, the pair of clip arms 6 and 6 projects from the pair of the ejectors 5 and 5 through the pair of headers 31 and 32. Then, the clip arms 6 and 6 of the pair extend toward each other in a direction substantially perpendicular to the inserting and extracting direction of the printed substrate 1. It should be noted that the ejector 5 and the clip arm 6 are integrally formed by way of an insulating synthetic resin.

With reference to the drawings again, a configuration of a connector 10 according to an embodiment of the present invention is explained. It should be noted that, since components are disposed symmetrically in the connector 10, a configuration associated with one header 31 is mainly described below.

Figure 4A:
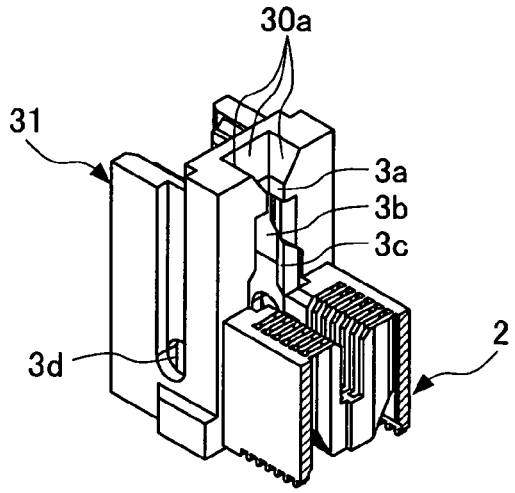
FIG. 4A is a perspective view illustrating one header provided to the electrical connector according to the embodiment.
Figure 4B:
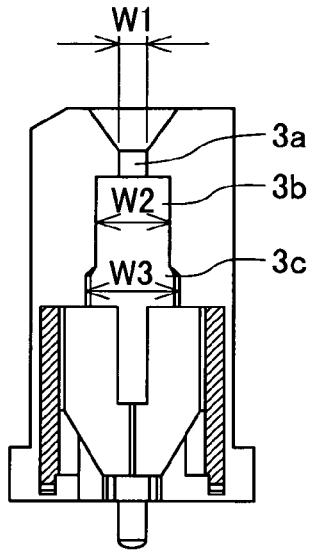
FIG. 4B is a front view of the header of FIG. 4A.

FIGS. 4A and 4B are views illustrating one header provided to the electrical connector according to the embodiment, with FIG. 4A being a perspective view of one header, and FIG. 4B being a front view of one header.

Figure 5A:
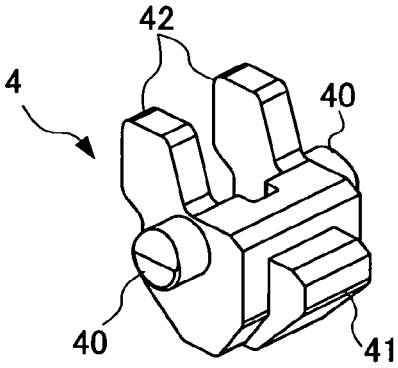
FIG. 5A is a perspective view illustrating the crank lever provided to the electrical connector according to the embodiment.
Figure 5B:
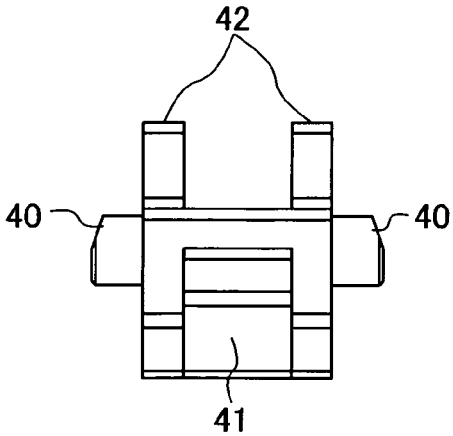
FIG. 5B is a front view of the crank lever of FIG. 5A.
Figure 6A:
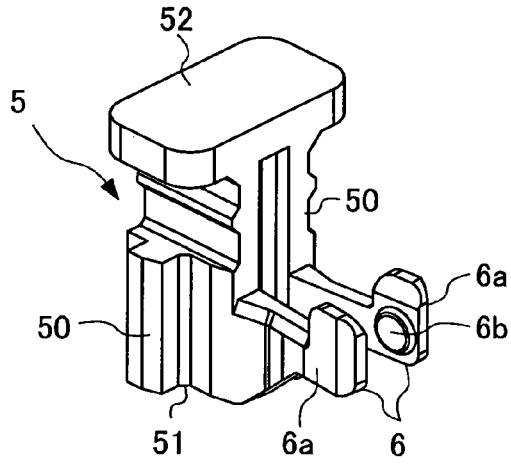
FIG. 6A is a perspective view illustrating the ejector provided to the electrical connector according to the embodiment.
Figure 6B:
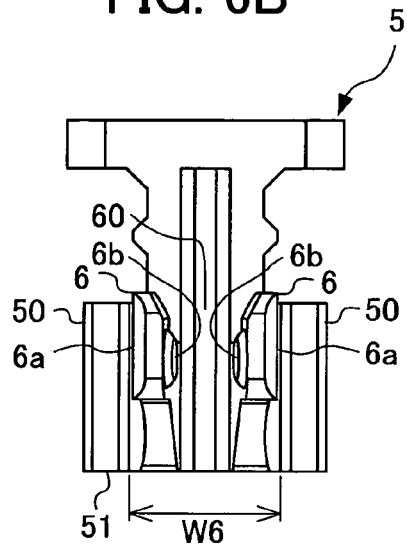
FIG. 6B is a front view of the ejector of FIG. 6A.

FIGS. 5A and 5B are views illustrating the crank lever provided to the electrical connector according to the embodiment, with FIG. 5A being a perspective view of a crank lever, and FIG. 5B being a front view of a crank lever. FIGS. 6A and 6B are perspective views illustrating the ejector provided to the electrical connector according to the embodiment, with FIG. 6A being a perspective view of an ejector, and FIG. 6B being a front view of an ejector.

Figure 7:
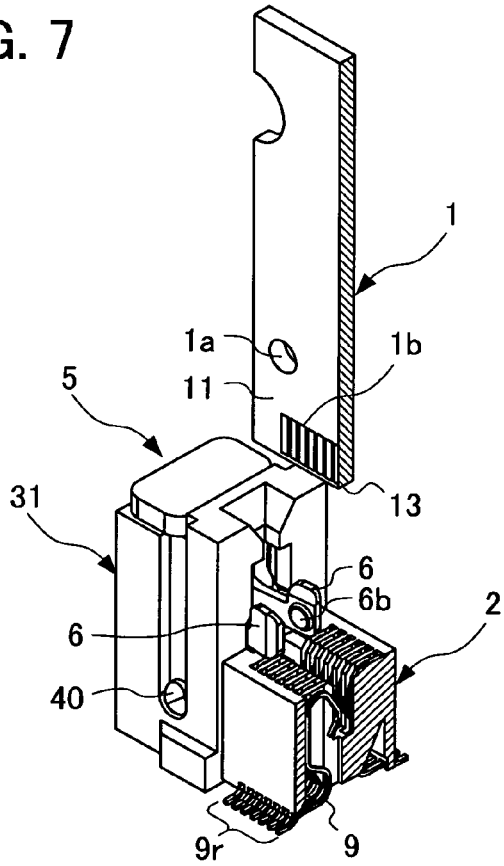
FIG. 7 is a perspective view illustrating a configuration of the electrical connector according to the embodiment and shows a state before the small printed substrate is connected as seen in a vertical sectional view perpendicular to a longitudinal direction.
Figure 8:
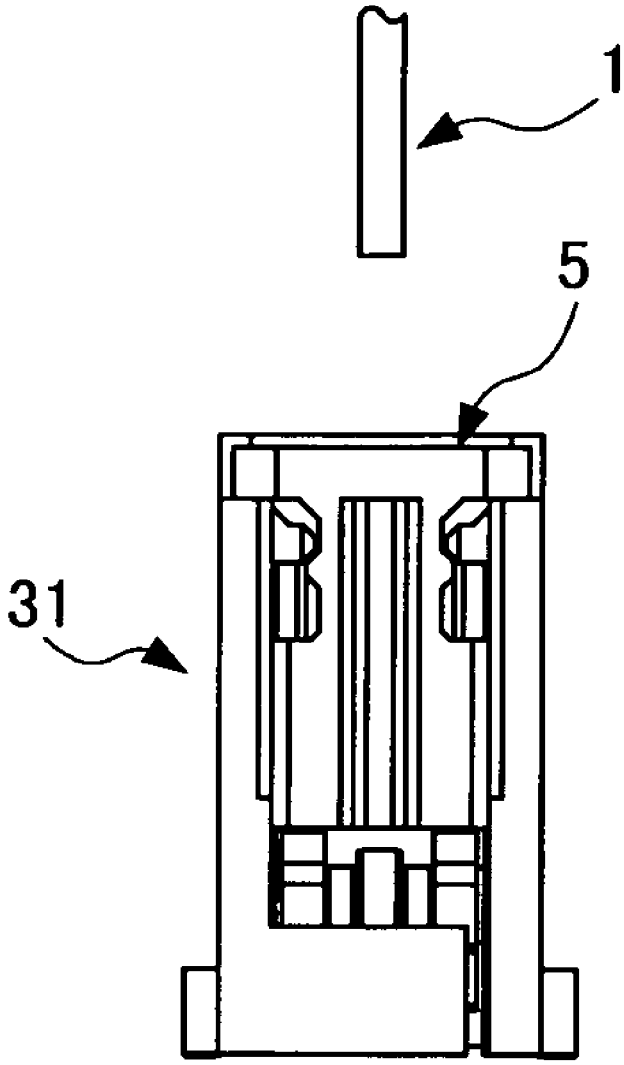
FIG. 8 is a left lateral view illustrating a configuration of the electrical connector according to the embodiment and shows a state before the small printed substrate is connected.

FIG. 7 is a perspective view illustrating a configuration of the electrical connector according to the embodiment and shows a state before the small printed substrate is connected as seen in a vertical sectional view perpendicular to a longitudinal direction. FIG. 8 is a left lateral view illustrating the electrical connector according to the embodiment and shows a state before the small printed substrate is connected.

Figure 9:
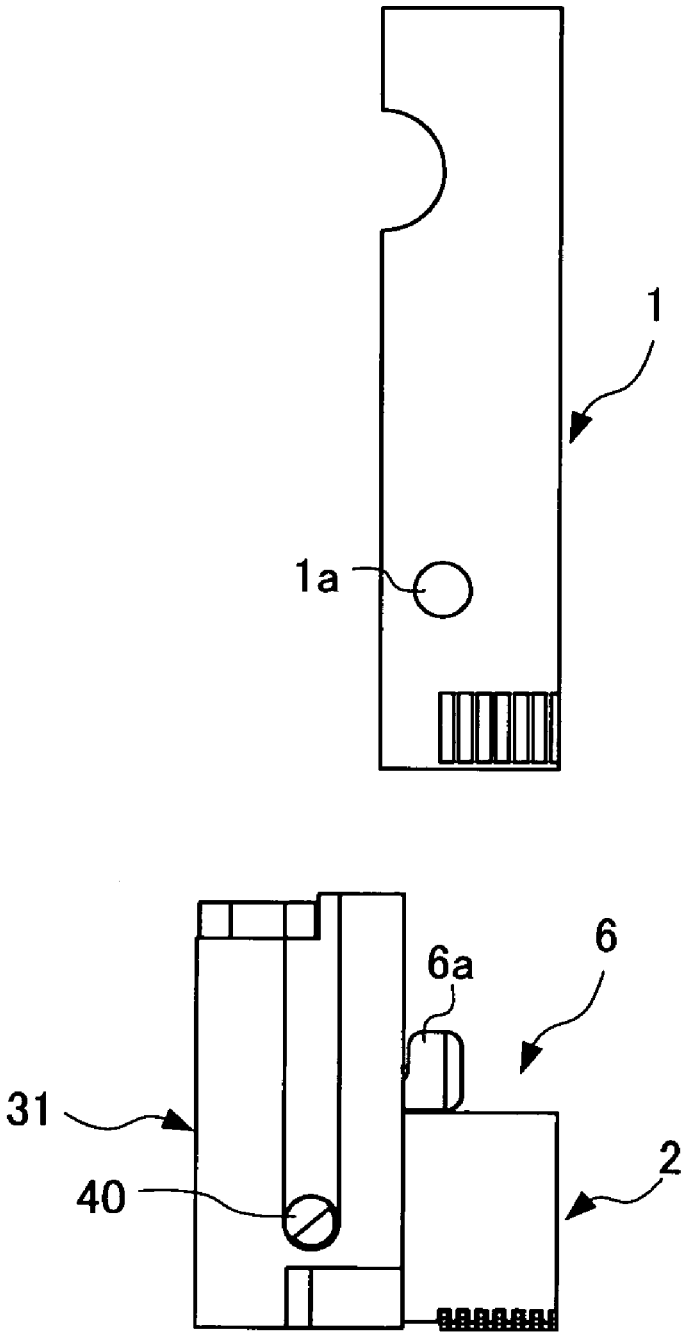
FIG. 9 is a front view illustrating a configuration of the electrical connector according to the embodiment and shows a state before the small printed substrate being connected as seen in a vertical sectional view perpendicular to a longitudinal direction.
Figure 10:
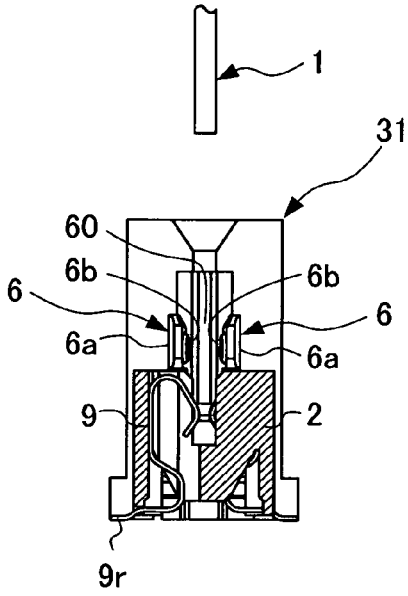
FIG. 10 is a left lateral view illustrating a configuration of the electrical connector according to the embodiment and shows a state before the small printed substrate is connected as seen in a vertical sectional view perpendicular to a longitudinal direction.

FIG. 9 is a front view illustrating a configuration of the electrical connector according to the embodiment and shows a state before the small printed substrate is connected as seen in a vertical sectional view perpendicular to a longitudinal direction. FIG. 10 is a left lateral view illustrating a configuration of the electrical connector according to the embodiment and shows a state before the small printed substrate is connected as seen in a vertical sectional view perpendicular to a longitudinal direction.

Figure 11:
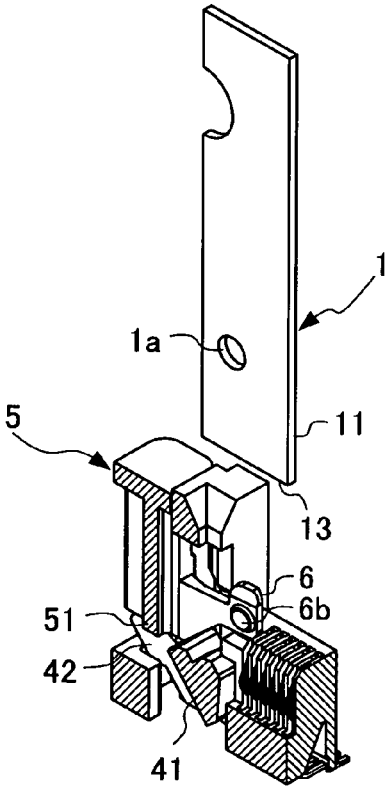
FIG. 11 is a perspective view illustrating a configuration of the electrical connector according to the embodiment and further shows a state before the small printed substrate is connected shown in FIG. 7 as seen in a vertical sectional view parallel with a longitudinal direction.
Figure 12:
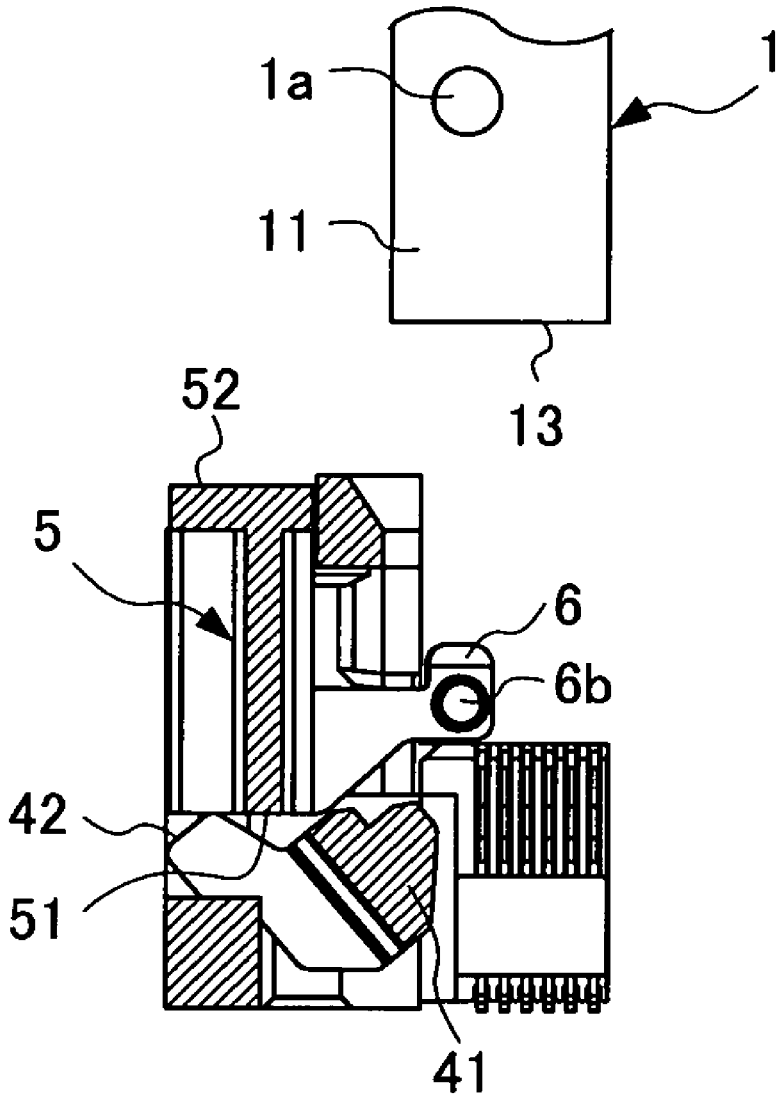
FIG. 12 is a front view illustrating a configuration of the electrical connector according to the embodiment and further shows a state before the small printed substrate is connected shown in FIG. 9 as seen in a vertical sectional view parallel with a longitudinal direction.

FIG. 11 is a perspective view illustrating a configuration of the electrical connector according to the embodiment and further shows a state before the small printed substrate is connected shown in FIG. 7 as seen in a vertical sectional view parallel with a longitudinal direction. FIG. 12 is a front view illustrating a configuration of the electrical connector according to the embodiment and further shows a state before the small printed substrate is connected shown in FIG. 9 as seen in a vertical sectional view parallel with a longitudinal direction.

With reference to FIGS. 1, and 4A and 4B, the pair of the headers 31 and 32 includes pairs of first to third grooves 3*a*, 3*b*, and 3*c*. First grooves 3*a* and 3*a* are directed from a tip portion to a base end portion of a pair of the headers 31 and 32. Furthermore, a pair of the first grooves 3*a* and 3*a* guides both end edges 12 and 12 of the printed substrate 1.

With reference to FIGS. 1, and 4A and 4B, a width W1 of the first groove 3*a* is slightly wider than a thickness t of the printed substrate 1. An entry of the first groove 3*a* is chamfered by a chamfer 30*a*, such that insertion of the printed substrate 1 is facilitated.

With reference to FIGS. 4A and 4B, and 6A and 6B, the second groove 3*b* is in communication with the first groove 3*a*. Furthermore, the second groove 3*b* is provided with a width W2, which is slightly narrower than a width W6 of both side faces 6*a* and 6*a* of the clip arm 6. The third groove 3*c* is in communication with the second groove 3*b*. The third groove 3*c* includes a width W3 at which both the side faces 6*a* and 6*a* of the clip arm 6 abut. Herein, the relationship of each width is made W1<W2<W3.

With reference to FIGS. 5A and 5B, the crank lever 4 includes a pair of pivot shafts 40 and 40, which extend in opposite directions. Furthermore, the crank lever 4 includes a first swing arm 41 and a second swing arm 42. The crank lever 4 allows the first swing arm 41 and the second swing arm 42 to swing about the pair of pivot shafts 40 and 40.

With reference to FIG. 3 or FIGS. 4A and 4B, a pair of holes 3*d* and 3*d*, which penetrate from one side face to the other side face, is provided at the base end portion of the header 31. Then, the pair of the pivot shafts 40 and 40 is held at these holes 3*d* and 3*d* to swing freely.

With reference to FIG. 11 or 12, the first swing arm can abut an end face of the connection end portion 11 of the printed substrate 1. On the other hand, the second swing arm 42 abuts a bottom face 51 of the ejector 5. When lowering the first swing arm 41, the second swing arm 42 can be raised. On the other hand, when lowering the second swing arm, the first swing arm 41 can be raised.

With reference to FIGS. 6A and 6B, the ejector 5 is provided with a pair of elongated protrusions 50 and 50, which extend in opposite directions. On the other hand, a pair of grooves (not shown) that guides a pair of the elongated protrusions 50 and 50 is provided at an inner wall of the header 31. That is, the ejector 5 is held at the header 31 to freely advance and retract. Regarding the ejector 5, a swinging movement of the crank lever 4 is converted to translatory movement, which is substantially parallel with an inserting and extracting direction of the printed substrate 1.

With reference to FIGS. 6A and 6B, and 10 to 12, the clip arm 6 includes a gap 60 through which the printed substrate 1 can pass. Furthermore, the clip arm 6 includes a pair of projections 6*b* and 6*b* that can fit the locking hole 1*a*.

With reference to FIGS. 6A and 6B, and 10 to 12, the gap 60 of the clip arm 6 opens from the base end portion toward the tip portion of the clip arm 6. Furthermore, a pair of the projections 6*b* and 6*b* is provided at the tip portion of the clip arm 6. Then, the pair of the projections 6*b* and 6*b* projects to the gap 60 toward each other.

Next, operations of the connector 10 according to an embodiment of the present invention are explained with additional configurations.

Figure 13A:
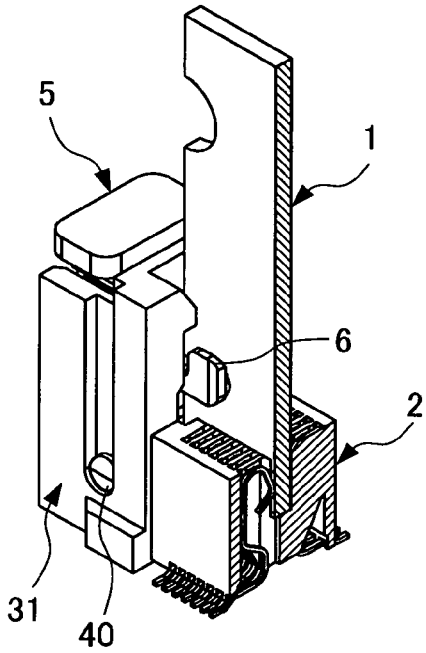
FIG. 13A is a perspective view of an electrical connector showing a state in which the small printed substrate is connected to the electrical connector according to the embodiment.
Figure 13B:
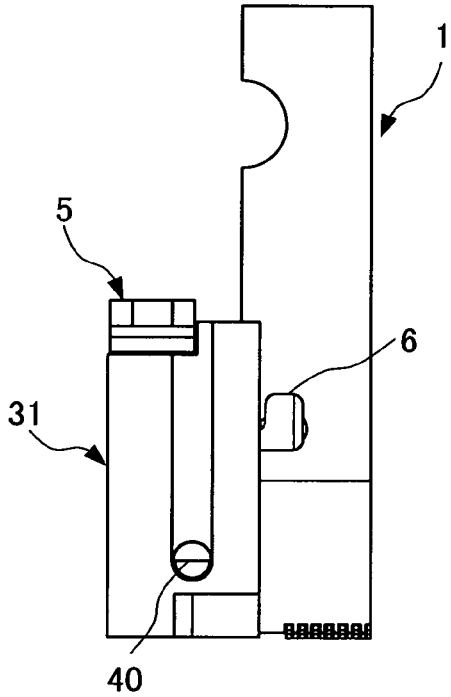
FIG. 13B is a front view of the electrical connector of FIG. 13A.
Figure 13C:
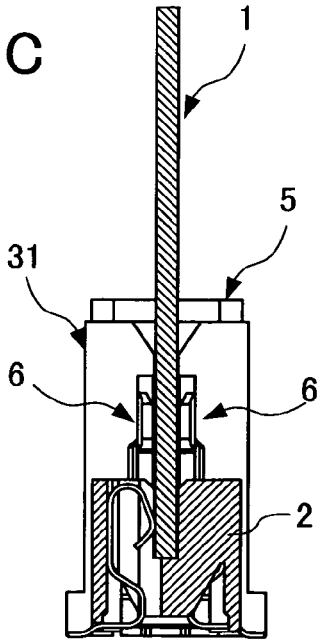
FIG. 13C is a right lateral view of the electrical connector of FIG. 13A.

FIGS. 13A, 13B, and 13C show states in which the small printed substrate is connected to the electrical connector according to the embodiment, with FIG. 13A being a perspective view of the electrical connector, FIG. 13B being a front view of the electrical connector, and FIG. 13C being a right lateral view of the electrical connector, in which either view of the small printed substrates is seen in a vertical sectional view perpendicular to a longitudinal direction.

Figure 14A:
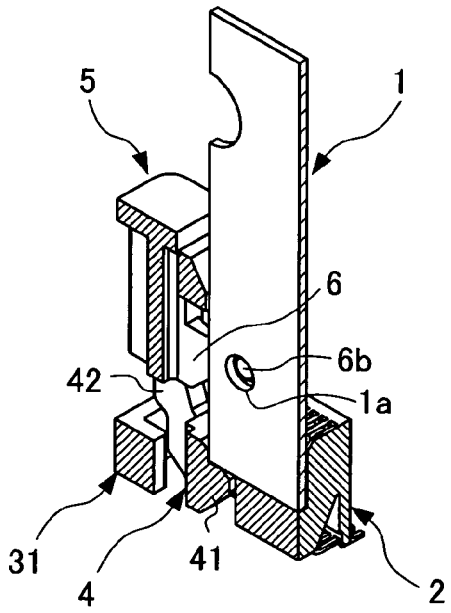
FIG. 14A is a perspective view of an electrical connector as seen in a vertical sectional view parallel with a longitudinal direction of FIG. 13A.
Figure 14B:
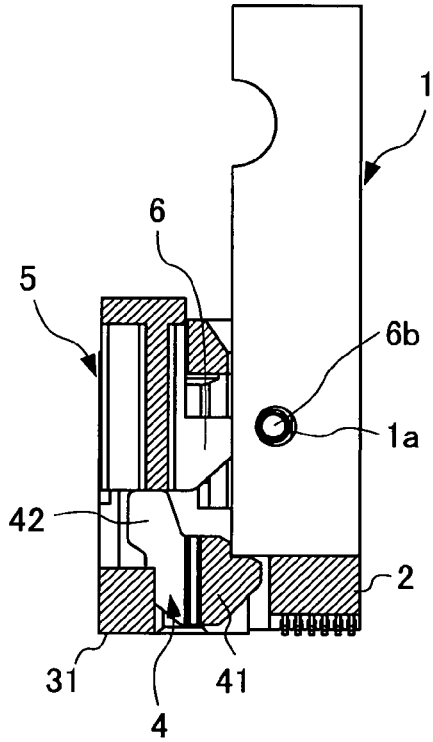
FIG. 14B is a front view of the electrical connector as seen in a vertical sectional view parallel with a longitudinal direction of FIG. 13B.

FIGS. 14A and 14B show states in which the small printed substrate is connected to the electrical connector according to the embodiment, with FIG. 14A being a perspective view of an electrical connector, and FIG. 14B being a front view of an electrical connector, in which either view of the small printed substrates is seen in a vertical sectional view parallel with a longitudinal direction of FIG. 13.

Figure 15A:
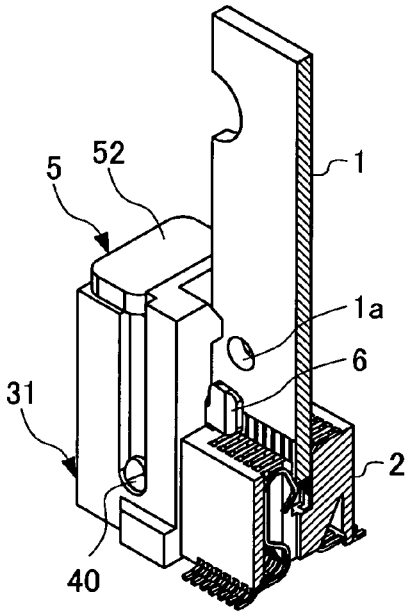
FIG. 15A is a perspective view of an electrical connector illustrating a state immediately after the small printed substrate has been ejected from the electrical connector according to the embodiment.
Figure 15B:
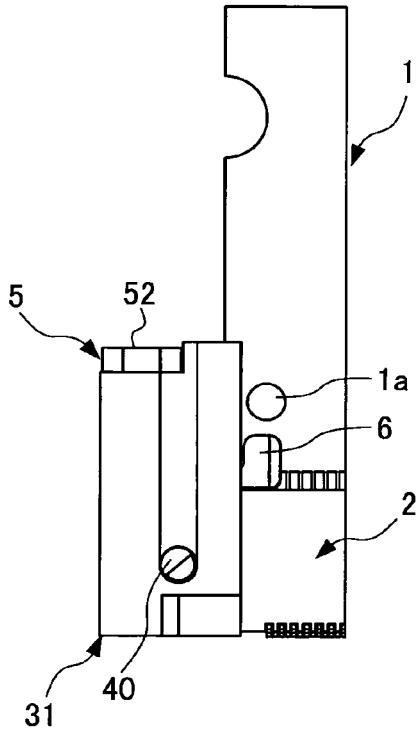
FIG. 15B is a front view of the electrical connector of FIG. 15A.
Figure 15C:
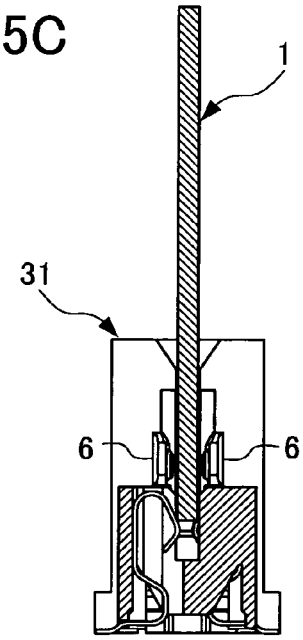
FIG. 15C is a right lateral view of the electrical connector of FIG. 15A.

FIGS. 15A, 15B, and 15C show states immediately after the small printed substrate has been ejected from the electrical connector according to the embodiment, with FIG. 15A being a perspective view of an electrical connector, FIG. 15B being a front view of an electrical connector, and FIG. 15C being a right lateral view of an electrical connector, in which either view of the small printed substrates is seen in a vertical sectional view perpendicular to a longitudinal direction.

Figure 16A:
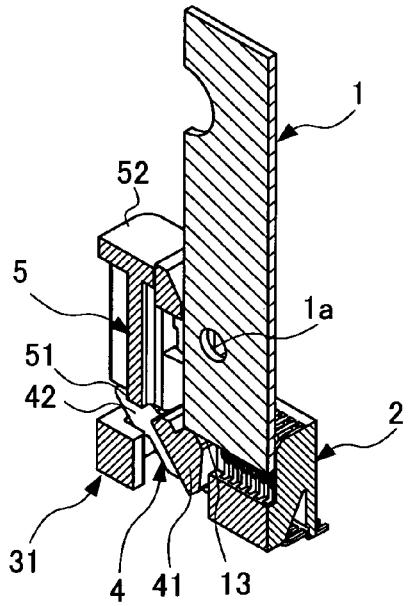
FIG. 16A is a perspective view of the electrical connector as seen in a vertical sectional view parallel with a longitudinal direction of FIG. 15A.
Figure 16B:
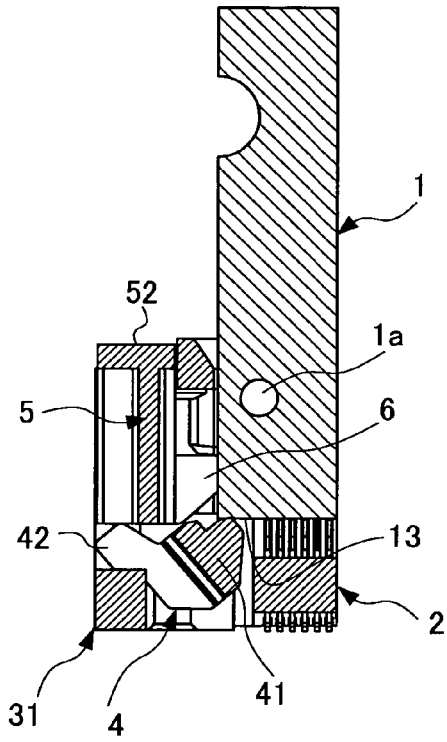
FIG. 16B is a front view of the electrical connector as seen in a vertical sectional view parallel with a longitudinal direction of FIG. 15B.

FIGS. 16A and 16B show states immediately after the small printed substrate has been ejected from the electrical connector according to the embodiment, with FIG. 16A being a perspective view of an electrical connector, and FIG. 16B being a front view of an electrical connector, in which either view of the small printed substrates is seen in a vertical sectional view parallel with a longitudinal direction of FIG. 15.

With reference to FIGS. 7 to 12, the crank lever 4 and the ejector 5 configure a cam device. In an example shown in the embodiment, the crank lever 4 is a cam and the ejector 5 is a cam follower. When the printed substrate 1 lowers the first swing arm 41, it is possible to raise the ejector 5 according the profile of the second swing arm 42. Herein, the header 31 functions as a frame that allows the ejector 5 only to undergo translatory movement.

Furthermore, with reference to FIGS. 7 to 12, the crank lever 4 and the printed substrate 1 configure a cam device. In an example shown in the embodiment, the crank lever 4 is a cam and the printed substrate 1 is a cam follower. When the ejector 5 lowers the second swing arm 42, it is possible to raise the printed substrate 1 according to the profile of the first swing arm 41. Herein, the header 11 functions as a frame that allows the printed substrate 1 only to undergo translatory movement.

With reference to FIGS. 13A to 13C, and 14A and 14B, when the printed substrate 1 is inserted into the housing 2, the crank lever 4 is caused to pivot so that the ejector 5 is caused to move in a direction opposite to an inserting direction of the printed substrate 1 (raising the ejector 5).

With reference to FIGS. 6A and 6B, the ejector 5 and the clip arm 6 are integrally configured, and a pair of the clip arms 6 and 6 is caused to move from the third groove 3*c* to the second groove 3*b* (see FIGS. 4A and 4B) to fit the locking hole 1*a* so as to sandwich both faces of the printed substrate 1.

With reference to FIGS. 6A and 6B or 13A to 13C, and 14A and 14B, the ejector 5 and the clip arm 6 are integrally configured, and when raising the ejector 5, the clip arm 6 moves from the third groove 3*c* to the second groove 3*b*, such that the clip arm 6 is elastically deformed toward the gap 60, a result of which the distance of the pair of the projections 6*b* and 6*b* is shortened. Then, the pair of the projections 6*b* and 6*b* can fit the through hole 1*a* so as to sandwich both faces of the printed substrate 1.

Thus, the connector 10 according to the embodiment of the present invention can securely lock the printed substrate 1 since the header 31 prevents widening the distance of the pair of the projections 6*b* and 6*b* even in a case in which a force aimed at detaching the printed substrate 1 from the housing 2 is acting thereon.

On the other hand, with reference to FIGS. 6A and 6B or 15A to 15C, and 16A and 16B, the ejector 5 includes a pressing portion 52 at an opposite side to a bottom face 51 of the ejector 5. When the pressing portion 52 is pushed so as to move the ejector 5 in a direction which is the same as an inserting direction of the printed substrate 1, the crank lever 4 pivots. Then, the profile of the first swing arm 41 pushes up the end face 13 of the printed substrate 1, such that the printed substrate 1 can be ejected from the housing 2.

With reference to FIGS. 4A and 4B or 15A to 15C, and 16A and 16B, the ejector 5 and the clip arm 6 are integrally configured, and when the ejector 5 is lowered, the clip arm 6 moves from the second groove 3*b* to the third groove 3*c*, such that the clip arm 6 elastically returns, a result of which the distance of a pair of the projections 6*b* and 6*b* can be returned to the initial state. Then, the pair of the projections 6*b* and 6*b* can be spaced apart from the locking hole 1*a* of the printed substrate 1.

Thus, the connector 10 according to the embodiment of the present invention can release the printed substrate 1 from the housing 2 by moving a pair of the ejectors 5 and 5 under pressure. Then, since the connector 10 according to the embodiment of the present invention is not provided with a pair of the ejectors that opens outwardly, as conventionally, a space is created for mounting electrical components to the main printed substrate 1*p*, which can improve packaging density.

Furthermore, with reference to FIGS. 1, 6A and 6B, in the connector 10 according to the embodiment of the present invention, since the projection 6*b* provided at the clip arm 6 projects in substantially a columnar manner, the locking hole 1*a* fits an outer circumference of the projection 6*b*, which makes it difficult for the projection 6*b* to cross over the locking hole 1*a*. That is, this can make it difficult for the printed substrate 1 to be detached due to vibration and the like.

Although the connector 10 according to the embodiment of the present invention is exemplified in which the printed substrate that is connected is a double-side printed substrate provided with an edge connector at both sides thereof, a printed substrate that is connected may be a single-side printed substrate including an edge connector on a single side thereof and may be a multi-layer printed substrate including an edge connector on a single side or both sides thereof.

Furthermore, although the connector 10 according to the embodiment of the present invention exemplifies a dual inline connector in which the contacts are arranged to be aligned in two rows, it may be a single inline connector in which the contacts are arranged to be aligned in one row.

Furthermore, although the connector 10 according to the embodiment of the present invention exemplifies a surface mount connector that is surface mounted to the main printed substrate, it can be applied to a type that is through-hole mounted to the main printed substrate.

In addition, although the connector 10 according to the embodiment of the present invention exemplifies a vertical installation connector, it may be a horizontal installation connector in which a printed substrate that is connected to a main printed substrate is inserted to and extracted from a horizontal direction.

What is claimed is:

1. An electrical connector comprising:

a housing of a quadrangular shape in which a printed substrate of a rectangular shape including a pair of locking holes at both wings of a connection end portion is inserted and extracted;

a pair of headers having base end portions that are disposed at both wings of the housing, and tip portions that extend in parallel;

a pair of crank levers that are held to freely swing at the base end portion of the pair of the headers;

a pair of ejectors that is held at a pair of the headers to freely advance and retract by a swinging movement of a pair of the crank levers being converted to translatory movement parallel with an inserting and extracting direction of the printed substrate; and a pair of clip arms that projects from the pair of ejectors through the pair of headers, and extends toward each other in a direction perpendicular to an inserting and extracting direction of the printed substrate, wherein the pair of headers includes a pair of first grooves facing each other that extends from the tip portions toward the base end portions and guides both end edges of the printed substrate, a pair of second grooves that is in communication with the first grooves and is provided at a width slightly narrower than a width of both side faces of the pair of clip arms, and a pair of third grooves that is in communication with the second grooves and abuts both side faces of the pair of clip arms, wherein the pair of crank levers includes a first swing arm that can abut both sides of an end face of the connection end portion and a second swing arm that abuts a bottom face of the pair of ejectors, wherein the clip arm includes a gap which opens from the base end portion toward the tip portion and through which the printed substrate can pass, and a pair of projections that is provided at a tip portion of the clip arm and projects to the gap toward each other so as to be capable of fitting the locking hole, and wherein, when the printed substrate is inserted into the housing, the pair of crank levers is caused to pivot so that the pair of ejectors is caused to move in a direction opposite to an inserting direction of the printed substrate and the pair of clip arms is caused to move from the pair of third grooves to the pair of second grooves to fit the pair of locking holes so as to sandwich both faces of the printed substrate.

2. The electrical connector according to claim 1, wherein the pair of ejectors includes a pressing portion at an opposite side to the bottom face of the ejector, and wherein, when the pressing portion is pushed so as to move the pair of ejectors in a direction which is the same as an inserting direction of the printed substrate, the pair of crank levers is caused to pivot so that the pair of first swing arms is caused to eject the printed substrate from the housing and the pair of clip arms is caused to move from the pair of second grooves to the pair of the third grooves so that the pair of projections is spaced apart from the pair of locking holes.

3. The electrical connector according to claim 1, wherein the projection projects in substantially a columnar manner.

4. The electrical connector according to claim 1, wherein the printed substrate includes an edge connector at the connection end portion, and the housing includes a plurality of contacts in a bellows shape that contacts the edge connector.

5. The electrical connector according to claim 4, wherein the housing arranges the contacts to be aligned in two rows.

6. The electrical connector according to claim 4, wherein the contact has a lead portion that is surface mounted.

* * * * *